US005595578A

United States Patent [19]

Stubbs et al.

[11] Patent Number: 5,595,578

[45] Date of Patent: Jan. 21, 1997

[54] COATED ABRASIVES UTILIZING A MOISTURE CURABLE POLYURETHANE HOT MELT MAKE COATING

[75] Inventors: Roy Stubbs, Nuneaton; Michael J. Hughes, Wombourne; James F. Morris-Adams, Moseley, all of Great Britain

[73] Assignee: Minnesota Mining and Manufacturing Company, St. Paul, Minn.

[21] Appl. No.: 288,404

[22] Filed: Aug. 10, 1994

[30] Foreign Application Priority Data

Aug. 11, 1993 [GB] United Kingdom ..... 93.16715

[51] Int. Cl.[6] ..... B24D 3/28; B24D 3/32

[52] U.S. Cl. ..... 51/295; 51/298

[58] Field of Search ..... 51/293, 295, 298

[56] References Cited

U.S. PATENT DOCUMENTS

| | | | |
|---|---|---|---|
| 4,011,063 | 3/1977 | Johnston | 51/295 |
| 4,240,807 | 12/1980 | Kronzer | 51/295 |
| 4,588,419 | 5/1986 | Caul et al. | 51/295 |
| 4,973,338 | 11/1990 | Gaeta et al. | 51/295 |
| 4,997,717 | 3/1991 | Rembold et al. | 478/413 |
| 5,055,113 | 10/1991 | Larson et al. | 51/295 |
| 5,137,984 | 8/1992 | Kangas et al. | 525/411 |
| 5,256,170 | 10/1993 | Harmer et al. | 51/295 |
| 5,256,227 | 10/1993 | Roelofs | 51/298 |
| 5,273,558 | 12/1993 | Nelson et al. | 51/298 |
| 5,305,560 | 4/1994 | Roelofs | 51/298 |
| 5,436,063 | 7/1995 | Follett et al. | 428/224 |

FOREIGN PATENT DOCUMENTS

| | | |
|---|---|---|
| 0344912 | 6/1989 | European Pat. Off. . |
| 0326704 | 9/1989 | European Pat. Off. . |
| 3515923A1 | 6/1986 | Germany . |
| 2070637 | 9/1981 | United Kingdom . |
| WO92/1301 | 8/1992 | WIPO . |

OTHER PUBLICATIONS

Chemical Abstracts, vol. 85, No. 10, 6 Sep. 1976, Columbus, Ohio, US; Abstract No. 64328a.

Derwent Publications Ltd., London, GB; Class ALC, AN94–077357 C10, Feb. 1, 1994 and Abstract J 06 023675.

Derwent Publications Ltd., London, GB; Class ALC, AN 91–012456 CO2, Nov. 26, 1990 and Abstract J 02286773.

*Primary Examiner*—Deborah Jones

*Attorney, Agent, or Firm*—Gary L. Griswold; Waltern N. Kirn; Doreen S. L. Gwin

[57] ABSTRACT

Coated abrasives are described comprising a backing substrate having coated thereon a moisture-cured polyurethane hot melt make coating and abrasive particles at least partially embedded therein. Methods of making the inventive coated abrasives are also presented.

41 Claims, 1 Drawing Sheet

COATED ABRASIVES UTILIZING A MOISTURE CURABLE POLYURETHANE HOT MELT MAKE COATING

BACKGROUND OF THE INVENTION

1. Field of the Invention

This invention relates to coated abrasives and to their preparation, and in particular to coated abrasives employing a moisture-cured polyurethane hot melt adhesive as a make coating.

2. Related Art

Coated abrasive products are normally prepared by coating one surface of a substrate with a first binder layer having adhesive properties, often referred to in the art as the "make" coating. Particles of abrasive material are applied to the coated substrate and partially embedded therein. A layer of a second binder, often referred to as the "size" coating, is then applied over the abrasive particles and make coating. The thickness of the second binder layer regulates the amount of the abrasive material extending above the binder medium. Anti-loading materials have generally been included in a further optional layer, referred to in the art as the "supersize" coating.

The adhesives used to form the make coating are generally water- or solvent-based and include phenolic resins, urea-formaldehyde, melamine-formaldehyde and combinations thereof. Other adhesives which have been used are based on animal hide glue and starch. Similar adhesives have been used for the size coating.

Many of the known adhesive systems which have been used in the above constructions are of low solids content requiring a high energy input for drying and the careful selection of backing materials. In the case of solvent-based adhesives, apparatus to extract solvent emissions can also be needed. Such extraction apparatus may also extract the fines from the abrasive particles leading to processing problems.

SUMMARY OF THE INVENTION

According to the present invention, coated abrasives are presented comprising a substrate bearing a layer of a moisture-cured hot melt polyurethane adhesive having abrasive particles at least partially embedded therein.

DESCRIPTION OF PREFERRED EMBODIMENTS

Figure 1:
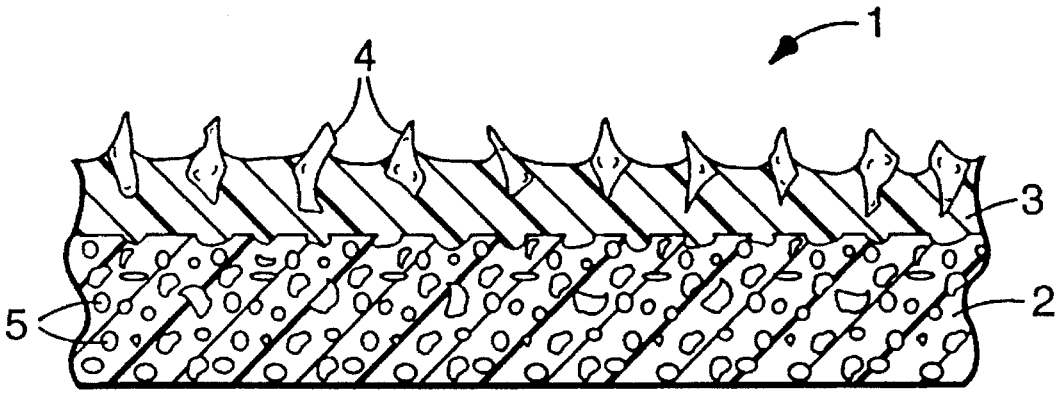
FIG. 1 is a cross-sectional view (enlarged) of a coated abrasive of the invention having a foam substrate layer.

FIG. 1 illustrates a preferred coated abrasive 1 in accordance with the invention, having an open-cell foam substrate layer 2 coated with a HMPU 3. Partially embedded in layer 3 are a plurality of abrasive particles 4. Note that the foam layer may be open or closed cell foam. At 5 are illustrated air voids (or other inert gas).

Figure 2:
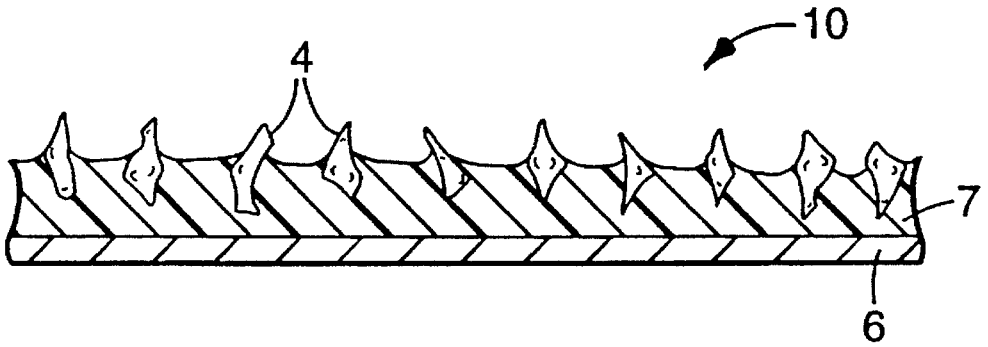
FIG. 2 is a cross-sectional view (enlarged) of a coated abrasive of the invention having a paper substrate layer.

FIG. 2 illustrates another embodiment 10 using paper 6 as substrate layer, having a coating 7 of HMPU and abrasive particles 4 thereon. Each embodiment 1 and 10 may optionally have size and supersize coatings (not shown).

It has been found that the use of a moisture-cured hot melt polyurethane adhesive as the make coating in coated abrasives provides a number of advantages over traditional water- and solvent-based make coatings. The hot melt adhesive is used at 100% solids content and by suitable selection of the application temperature will maintain the desired orientation of the abrasive particles. The hot melt adhesive is compatible with many size formulations and allows the application of water-based size over the make coating and abrasive particles, the moisture content of the size coating participating in the curing of the make coating, ensuring strong bonding between the make and size coatings. Other size coatings may be employed, e.g., hot melt, solvent-based formulations, or radiation cured resins which sizes may be applied before or after complete curing of the make coating.

Moisture-curable hot melt adhesives useful in the invention are 100% solid polymeric materials. They are generally composed of a combination of a moisture-curable polyurethane resin precursors, waxes (particularly paraffin waxes) and stabilizers. The polyurethane resin component in the cured composition is typically present at from about 50 to 99 weight percent, the wax at from about 1 to 49 weight percent, and the stabilizers typically not more than 1 weight percent, all weights based on total weight of moisture-cured hot melt adhesive. Coating is normally by die coating or extrusion, but can also be by spray coating. Moisture-cured polyurethanes are derived from isocyanate-terminated prepolymers which, after application, are cured by reaction of the residual isocyanate groups with moisture. The amino groups initially formed react with more isocyanate groups to form urea linkages. Thus, the term "polyurethane" is meant to include polyurea linkages.

The moisture-curable hot melt polyurethane (HMPU) may be applied to any substrate which will withstand the application temperature of the adhesive. Suitable substrates include paper, cloth and foam. The HMPU may be coated directly on the substrate or a priming or presize layer may be applied prior to its application. Such presize layers may be solvent-based, water-based or hot melt. The presize layer is conveniently hot melt since it may readily be applied at the same coating station as the HMPU make. Presize layers are particularly useful on substrates which have rough surfaces or substrates with voids e.g., open-cell foams, and woven and non-woven fabrics, since it assists in smoothing the surface and reduces the amount of HMPU required, which tends to be a more expensive component than the presize material. Presize layers are not normally required on closed-cell foams and other substrates having a substantially sealed surface.

Suitable HMPU adhesives are commercially available under the trade names Tivomelt 9617/11, 9628 and 9635/12 from Tivoli; Purmelt QR116 and QR3310-21 from Henkel and Jet Weld TS-230 from Minnesota Mining and Manufacturing Company, St. Paul, Minn. ("3M").

The preparation of isocyanate-terminated prepolymers is well known in the art. Suitable prepolymers with residual isocyanate groups are formed by reaction of (1) a mixture of two or more hydroxy functional polymers wherein the total mixture generally has a combined number average molecular weight of about 1,000 to 10,000, preferably of about 1,000 to 6,000 and more preferably of about 3,000 to 4,500 and (2) a polyisocyanate, preferably a diisocyanate.

Examples of useful hydroxy functional polymers are polyester, polyactone, polyalkylene or poyalkylene ether, polyacetal, polyamide, polyesteramide or polythioether polyols. Preferred prepolymers are those based on linear aliphatic or slightly branched polyesters containing primary hydroxyl end groups. Other useful polyesters contain secondary hydroxyl or carboxyl end groups.

The prepolymer is preferably at least partially comprised of crystalline or semicrystalline polyester diols. Preferred polyesters have melting points between 30° C. and 80° C., most preferred between 40° C., and 60° C. Amorphous polyesters with glass transition temperatures up to 50° C. may be useful in blends at less than 50% total polyester weight. In certain cases liquid polyesters may be useful in blends of polyesters at less than 30% total polyester weight. Such preferred polyesters can be prepared by reacting a diol with a diacid or derivatives of diacids. Especially preferred are polyesters prepared by reacting short chain diols having the structure $HO—(CH_2)_x—OH$, where x is from 2 to 8, with diacids having the structure $HOOC—(CH_2)_y—COOH$, where y is from 1 to 10. Examples of useful diols include ethylene glycol, 1,4-butanediol, 1,6-hexanediol; 1,4-cyclohexane dimethanol, neopentyl glycol and 1,2-propylene glycol. Examples of useful diacids include adipic, azelaic, succinic, and sebacic acids. Small amounts of triols, polyethers and up to 30 mole percent of other diacids and anhydrides such as isophthalic, terephthalic, cyclohexane dicarboxylic acid and phthalic anhydride may also be useful in the preferred polyester-synthesis.

Examples of commercially available polyesters that are useful in the compositions of the invention are the "Lexorez" series commercially available from Inolex Chemical Co. Specific examples of such resins include Lexorez 1130-30P, Lexorez 1110-25P. Examples of other commercially available polyesters useful in the invention are the "Rucoflex" series of resins available from Ruco Polymer Corporation.

An example of a commercially available polylactone that is useful in the invention is "Tone-0260", commercially available from Union Carbide. Component ratios can be determined by the performance properties desired.

Preferred mixtures of hydroxy functional polymers are (1) linear polyester blends, wherein said polyester is the reaction product of a polyol and a polyacid, wherein
$a+b$<or=4, $c+d$>or=6
$a+b$>4 and≦6, $c+d$>or=10
$a+b$>6 *and*≦8, $c+d$>or=12 wherein a is the number of methylene moieties in the polyol used to form the first polyester, b is the number of methylene moieties in the polyacid used to form the first polyester, c is the number of methylene moieties in the diol or polyol used to form the second polyester of the blend, d is the number of methylene moieties in the polyacid used to form the second polyester of the blend; or (2) a blend of at least one non-linear polyester and one linear polyester, wherein the nonlinear polyester is selected from the group consisting of polyneopentyl adipate, polypropylene adipate and polycyclohexanedimethyl adipate, and the linear polyester is selected from the group consisting of polyethylene adipate, polybutylene succinate, and polyhexamethylene sebacate, provided that when the linear polyester is polyhexamethylene sebacate, the non-linear polyester is polyneopentyl adipate or polypropylene adipate.

A blend of poly ϵ-caprolactone and at least one linear polyester selected from the group consisting of polyethylene adipate, polyethylene succinate and polybutylene succinate.

Particularly preferred mixtures of hydroxy functional polymers are:

(1) linear polyester blends, wherein the polyester is the reaction product of a diol and a diacid, wherein
$a+b=4$, $c+d$>or=6
$a+b=6$, $c+d$>or=10
$a+b=8$, $c+d$>or=12 wherein a, b, c and d are as described above;

(2) a blend of a linear and non-linear polyesters, wherein the non-linear polyester is selected from the group consisting of polyneopentyl adipate, polypropylene adipate and polycyclohexanedimethyl adipate, and the linear polyester is selected from the group consisting of polyethylene adipate, polybutylene adipate and polyhexamethylene sebacate, provided that when the linear polyester is polyhexamethyl sebacate, the nonlinear polyester is polyneopentyl adipate or polypropylene adipate;

(3) a mixture of polyethylene adipate and polyhexamethylene adipate; or (4) a mixture of linear polyesters wherein one of the linear polyesters is poly ϵ-caprolactone and the others are selected from the group consisting of polyethylene adipate, polyethylene succinate and polybutylene succinate.

The ratio of polyesters employed in the invention can vary in the composition. However, it has been found preferable to employ a weight ratio of first to second polyesters in the range of between about 85:15 to 15:85, more preferably 80:20 to 20:80, most preferably 70:30 to 30:70.

The polyisocyanates which are reacted with the hydroxy functional polymers to form the prepolymers used in the instant invention can be aliphatic or aromatic. Preferably they are aromatic diisocyanates such as diphenylmethane-2,4'-diisocyanate and/or 4,4'-diisocyanate; tolylene-2,4-diisocyanate; and -2,6-diisocyanate and mixtures thereof. Other examples include: naphthylene-1,5-diisocyanate; triphenylmethane-4,4'4"-triisocyanate; phenylene-1,3-diisocyanate and -1,4-diisocyanate; dimethyl-3,3'-biphenylene-4,4'-diisocyanate; diphenylisopropylidine-4,4'-diisocyanate; biphenylene diisocyanate; xylylene-1,3-diisocyanate and xylylene -1,4-diisocyanate.

A list of useful commercially available polyisocyanates is found in the *Encyclopedia of Chemical Technology*, Kirk-Othmer, 2nd Ed., Vol. 12, pp. 46–47, Interscience Pub., N.Y. (1967), which is incorporated herein by reference. Especially preferable isocyanates include diphenylmethane-4-4'-diisocyanate (MDI) and tolylene-2,4-diisocyanate/tolylene-2,6-diisocyanate (TDI) and mixtures thereof.

Isocyanate-functional derivative(s) of MDI and TDI may be used, such as liquid mixtures of the isocyanate-functional derivative with melting point modifiers (e.g., mixtures of MDI with polycarbodiimide adducts such as "Isonate 143L", commercially available from Mobay Chemical Corp.; small amounts of polymeric diphenylmethane diisocyanates, preferably 10% or less by eight of the total isocyanate component, (e.g., "PAPI", and the series "PAPI 20" through "PAPI 901,"commercially available from the Dow Chemical Co., "Mondur MR", "Mondur MRS", and "Mondur MRS-10", commercially available from Mobay Chemical Co., and "Rubinate M", commercially available from ICI Chemicals, Inc.); and blocked isocyanate compounds formed by reacting aromatic isocyanates or the above-described isocyanate-functional derivatives with blocking agents such as ketoximes and the like. Such blocked isocyanate-functional derivatives, will for convenience, be regarded herein as isocyanate-functional derivatives of MDI and TDI.

The isocyanate should be present in the prepolymer composition in an equivalent amount greater than that of the hydroxy containing component. The equivalent ratio of isocyanate to hydroxyl is preferably from about 1.2 to about 10 to 1.0 and especially preferably from about 1.6 to 2.2. to 1.0.

The HMPU compositions of the invention can contain other ingredients or adjuvants if desired. For example, chain extension agents (e.g., short chain polyols such as ethylene glycol or butanediol) fillers (e.g. carbon black, metal oxides such as zinc oxide, and minerals such as talc clays, silica, silicates, and the like), thermoplastic resins, plasticizers, antioxidants, pigments, U.V. absorbers, and the like may be included to impart particular characteristics to the HMPU composition. These adjuvants generally comprise up to 50 weight percent of the HMPU composition either individually or in combination. If the HMPU is desired to be "non-hairing" the adjuvants should only be added to the levels that do not interfere with this, as taught in U.S. Pat. No. 5,137,984, incorporated by reference herein.

Other preferred HMPUs are disclosed in assignee's U.S. Ser. Nos. 07/515,113, filed Apr. 24, 1990; 07/646,067, filed Jan. 25, 1991; 08/047,861, filed Apr. 15, 1993; and 08/166,550, filed Dec. 4, 1993, all incorporated herein by reference.

In addition, the HMPU compositions can contain an effective amount of catalyst or reaction accelerator such as tertiary amines, metal-organic compounds, co-curatives, such as oxazolidine, and the like. Dibutyltin dilaurate is a preferred metal-organic catalyst. An effective amount of metal-organic catalyst is preferably from about 0.01 to 2 percent by weight of the prepolymer. More preferably, the catalyst is present at a level of about 0.05 to about 1 percent, based on the weight of the prepolymer.

The HMPU adhesive compositions useful in the invention may be prepared by mixing the components at elevated temperature, using conventional mixing techniques. It is preferred to mix the components under anhydrous conditions. Generally, preparation of the HMPU adhesive is done without the use of solvents.

The HMPU compositions useful in the invention achieve their initial, or green, strength through crystallization, then continue to cure by exposure to water, e.g., water vapor or moisture. High humidity and heat will provide an accelerated rate of cure while low humidity (e.g. 15% R.H. or less) will provide a slower rate of cure.

While the HMPU compositions useful in the invention are preferably essentially non-phasing, some separation of the polyester components is acceptable. Moreover, the degree of phasing can be adjusted by varying any or several of certain factors. For example, the degree of chain extension of the polyester, the molecular weight of the polyester and the choice of isocyanate all influence phase separation. For example, as the molecular weight of the polyester decreases, the compatability of the blend increases Additionally, as the NCO:OH ratio decreases the compatibility of the components in the prepolymer increases. Moreover, simply varying the ratios of the polyester components influences their compatability.

The HMPU used in a given application will be selected according to the particular requirements. As a general guide, polyurethanes having viscosities in the range 3,000 to 12,000 mPa.s (Brookfield) at 120° C. are suitable, but those exhibiting higher or lower values may be appropriate in certain circumstances. For example, a less viscous polyurethane will normally be required if a lower coating temperature is to be used, and a more viscous polyurethane may be suitable if a higher coating temperature can be tolerated.

The previously mentioned HMPU known under the trade designation "Jet-Weld TS-230", available from 3M, is another preferred HMPU. This particular HMPU has the uncured and cured physical properties listed in Tables 1 and 2.

TABLE 1

Typical Uncured Properties of "Jet-Weld TS-230"

| | |
|---|---|
| Application temp. | 121° C. |
| Viscosity[1] (at 121° C.) | 9,000 centipoise |
| Color (solid) | white/off-white |
| Open time[2] | 4 minutes |
| Set time[3] | 2.5 minutes |
| Lbs/gallon (molten) | 9.1 |

[1]measured on a Brookfield viscometer with Thermosel using spindle #27
[2]the bonding range of a ⅛ inch bead of molten adhesive on a non-metallic substrate
[3]the minimum amount of time required between the bond being made and when it will support a 10 psi tensile load

TABLE 2

Typical Cured Properties of "Jet-Weld TS 230"

| | |
|---|---|
| Shore D Hardness | 45 |
| Tensile Strength at Break (ASTM D-638, Die C)* | 3,300 psi |
| 100% modulus (ASTM D-638, Die C) | 1,100 psi |
| Elongation at Break (%) (ASTM D-638, Die C) | 625% |

*"ASTM" is American Society for Testing and Materials

Suitable size materials include those commercially available under the trade names Evode DP-90-4101, a water-based acrylic from Evode; Witcobond 732, 769 and 788, water-based polyurethanes from Baxenden, urea, melamine- and phenol-formaldehydes, water-based epoxy systems, and combinations thereof. It is also possible to use calcium stearate in a size binder, normally an acrylic binder. The size layer may include additives such as grinding aids, lubricants, antiloading compounds, in amounts dictated by the workpiece.

Suitable presizes including those commercially available under trade names Thermaflow 6876, a hot melt ethylene vinyl acetate from Evode, 3M 3748, a hot melt polyethylene from 3M, and 3M 3789, a hot melt polyamide from 3M. HMPUs, including moisture-curable HMPUs, may also be employed. In some circumstances, a pre-formed film may be applied to the substrate. This is a useful option where the substrate is a foam, or a woven or non-woven fabric.

The inventive coated abrasives may also comprise a supersize coating, preferably of the type disclosed in EP-0433031. Particularly preferred supersize compositions comprise calcium stearate and a fluorinated additive, e.g., FC396 from 3M, in a water-based acrylic binder, e.g., Vinacryl 71322 from Vinamul.

The make coating is generally applied by heating the HMPU to a temperature at which the viscosity is suitable for coating and applying the molten material to the substrate by an extrusion die. Coating temperatures depend upon the particular HMPU but are generally in the range 50° to 200° C., usually in the range 120° C. to 160° C. The coating weight depends upon the surface and porosity of the substrate, the presence or absence of a presize, and the size of the abrasive particles. Coating weights are generally within the range 1 to 250 g/m$^2$, the lower end of the range being applicable to smooth substrates, e.g., paper and fine grade abrasive particles.

Hot melt presize coatings may be applied in a similar manner to the make coating.

The abrasive particles are generally applied to the coated substrate immediately after application of the HMPU, e.g., by passing the substrate through a curtain of abrasive particles or by electrostatic coating. Preferably the abrasive particles are heated prior to application, e.g., from 30° to 150° C. usually about 50° C.

Individual abrasive particles may be selected from those commonly used in the abrasive art, however, the abrasive particles (size and composition) will be chosen with the application of the abrasive article in mind. In choosing an appropriate abrasive particle, characteristics such as hardness, compatibility with the intended workpiece, particle size, reactivity with the workpiece, as well as heat conductivity may be considered.

The composition of abrasive particles useful in the invention can be divided into two classes: natural abrasives and manufactured abrasives. Examples of natural abrasives include: diamond, corundum, emery, garnet, buhrstone, chert, quartz, sandstone, chalcedony, flint, quartzite, silica, feldspar, pumice and talc. Examples of manufactured abrasives include: boron carbide, cubic boron nitride, fused alumina, ceramic aluminum oxide, heat treated aluminum oxide, alumina zirconia, glass, silicon carbide, iron oxides, tantalum carbide, cerium oxide, tin oxide, titanium carbide, synthetic diamond, manganese dioxide, zirconium oxide, and silicon nitride.

Abrasive particles useful in the invention typically and preferably have a particle size ranging from about 0.1 micrometer to about 1500 micrometers, more preferably ranging from about 0.1 micrometer to about 1300 micrometers. The abrasive particles preferably have an average particle size ranging from about 0.1 micrometer to about 700 micrometers, more preferably ranging from about 1 to about 150 micrometers, particularly preferably from about 1 to about 80 micrometers. It is preferred that abrasive particles used in the invention have a Moh's hardness of at least 8, more preferably above 9; however, for specific applications, softer particles may be used.

The term "abrasive particle" includes agglomerates of individual abrasive particles. An abrasive agglomerate is formed when a plurality of abrasive particles are bonded together with a binder to form a larger abrasive particle which may have a specific particulate structure. The plurality of particles which form the abrasive agglomerate may comprise more than one type of abrasive particle, and the binder used may be the same as or different from the binders used to bind the agglomerate to a backing.

A size coating precursor composition may be applied directly after application of the abrasive particles. The size coating precursor composition is preferably water-based and may readily be applied by spray-coating, roller-coating etc. The weight ratio of adhesive:water in the size coating precursor composition is generally within the range 10:1 to 1:2, preferably from 1:1 to 2:1. The coating weight is generally in the range 1 to 250 g/m$^2$ solids and is normally dependent on the grade of abrasive particles.

In absence of a water-based size coating the material is preferably sprayed with water or placed in a moist environment to cure the HMPU.

After application of the size coating precursor composition or water the material is dried, e.g., by force drying in a tunnel oven with infrared heaters. Suitable drying temperatures and times will depend on the particular size coating chemistry, percent solids, and the like. A typical drying temperature ranges from about 50° C. to about 90° C. As drying temperature increases, the amount of time at that temperature generally decreases.

Following drying, the inventive coated abrasive is preferably allowed to stand for a period of at least 24 hours to allow thorough curing of the HMPU.

A particularly preferred product in accordance with the invention is an abrasive sponge, e.g., a foam strip of thickness in the range 2 to 15 mm having abrasive particles and HMPU coated on one major surface. The invention allows such a substrate coated with abrasive and HMPU to be in sheet form or as a web from a roll. The sponge may be formed in situ in the apparatus upstream of the HMPU and abrasive particle coating station. Foam blocks, e.g., of thickness about 25 mm may also be abrasive coated in accordance with the invention. The invention is not limited to coating a single surface and articles having double sized abrasive coatings optionally of different abrasive grade may readily be prepared. Abrasive coating on some or all sides of a foam block is also possible.

The invention may employ abrasive particles of all types and grades. When coating fine abrasive particles on a rough or porous substrate it may be desirable to employ a presize in the form of a transferable film to seal the surface thereby preventing the abrasive particles from entering the pores or cells and ensuring they remain at the surface.

The invention will now be illustrated by the following Examples.

EXAMPLE 1

A series of abrasive elements were made by coating sheets of an open cell polyester-urethane foam having a density of 50 to 100 kg/m$^3$ and a thickness of 5 mm.

A presize coating of an EVA known under the trade designation Evode Thermaflow 6876 was applied through an extrusion die at a temperature of 210° C.

A moisture-curable polyurethane hot melt adhesive known under the trade designation Purmelt QR 3310-21 or Tivomelt 9617/11 was then applied over the hot presize from an extrusion die at a temperature of 120° C.

The coated sheet was immediately passed through a curtain of abrasive particles heated to 50° C. Excess particles were shaken from the coated sheet.

Water-based size was spray-coated over the sheet. The sizes used were Evode DP-90-4104, an acrylic adhesive, and Witcobond 769 and Witcobond 788, polyurethane adhesives, at adhesive:water weight ratio of 2:1 for each size.

The resulting sheet was force dried in a tunnel oven at about 60° C. for 90 seconds. Thereafter the sheets were stored on racks at ambient temperature for 24 hours. The sheets were tested for abrasive properties after 7 days.

The following samples were prepared, wherein the coating weight of the size coating is on a solids basis.

Sample 1 make : Purmelt QR3310-21 coating weight 60 g/m$^2$
size : Witcobond 769; coating weight 20–50 g/m$^2$
abrasive : P120 (average particle size of about 120 micrometers) white Alox (aluminum oxide); coating weight 120 g/m$^2$

Sample 2 make : Purmelt QR3310-21; (200 g/m$^2$)
size : Witcobond 769 (20–50 g/m$^2$)
abrasive P120 white Alox (120 g/m$^2$)

Sample 3 make : Tivomelt 9617/11
size : Witcobond 769 (20–50 g/m$^2$) abrasive : P120 white Alox (120 g/m$^2$)

Sample 4 make : Purmelt QR3310-21 coating weight 80 g/m$^2$
size : Evode DP-90-4104
abrasive : P60 (average particle size of about 350 micrometers) BFRPL (aluminum oxide).

Sample 5 make : Purmelt QR3310-21 coating weight 140 g/m$^2$
size : Eovde DP-90-4104
abrasive : P60 BFRPL Sample 6 make : Purmelt QR3310-21 coating weight 80 g/m$^2$
size : Witcobond 788
abrasive : P60 BFRPL Sample 7 make : Purmelt QR3310-21 coating weight 140 g/m$^2$
size : Witcobond 788
abrasive : P60 BFRPL The samples were tested by rubbing painted steel automobile panels both wet and dry. Coating loss was tested by folding material in half abrasive-to-abrasive and rubbing the two halves against each other. Samples 1 and 3 were experimental, and the respective coating weights given are only estimates. Sample 3 is based on a foam strip pre-coated with the polyurethane, of which the coating weight is unknown. In each of Samples 4 to 7, the size layer was applied with a dry coating weight of 20 to 40 g/m$^2$, and the abrasive with a coating weight of 450 to 500 g/m$^2$. All samples gave acceptable performance in each test.

EXAMPLE 2

Another experimental Sample 8 was made similar to Sample 1 except that a solvent-base polyurethane was employed as a size. The abrasive product had acceptable performance but not as good as samples using water-based size.

EXAMPLE 3

A paper substrate was coated in a similar manner to Example 1 with the presize; a make consisting of Purmelt QR3310-21 (60 g/m$^2$); a conventional urea formaldehyde size (20–50 g/m$^2$) and an abrasive coating of P120 white Alox (120 g/m$^2$). Sample 9 performed acceptably and was considerably more aggressive than the sponge products.

EXAMPLE 4

Samples were prepared in a similar manner to those in Example 1 utilizing an anti-loading composition as a size and supersize.

The anti-loading composition (ALC) comprised: 200 parts by weight filled calcium stearate (Henkel Nopco EC 769); 40 parts by weight water based acrylic binder (Vinacryl 71322); 2 parts by weight fluorochemical ester-acrylate (3M FC396).

The mixture was diluted to 40% solids in water.

Sample 10 make : Purmelt QR3310-21 (75 g/m$^2$)
size : Witcobond 769 (approx. 60 g/m$^2$ dry)
abrasive : P60 BFRPL (approx. 460 g/m$^2$)

Sample 11 make : Purmelt QR3310-21 coating weight 75 g/m$^2$
size : ALC (approx. 90 g/m$^2$ dry)
abrasive : P60 BFRPL (approx. 460 g/m$^2$)

Sample 12 make : Purmelt QR3310-21 coating weight 75 g/m$^2$
size : Witcobond 769 (approx. 60 g/m$^2$ dry)
supersize : ALC (approx. 90 g/m$^2$)
abrasive : P60 BFRPL (approx. 460 g/m$^2$)

All samples gave satisfactory performance. Samples 11 and 12 gave improved cutting performance, both wet and dry, compared to Sample 10.

What is claimed is:

1. A coated abrasive comprising a substrate bearing a layer of a moisture-cured hot melt polyurethane adhesive having a plurality of abrasive particles at least partially embedded therein.

2. A coated abrasive as claimed in claim 1 wherein the substrate is porous.

3. A coated abrasive as claimed in claim 1 which comprises a presize coating between the substrate and the hot melt polyurethane adhesive.

4. A coated abrasive as claimed in claim 2 which comprises a presize coating between the substrate and the hot melt polyurethane adhesive.

5. A coated abrasive as claimed in any of claims 1, 2 or 3 in which the substrate is selected from paper, plastic fibers, fibrous bases, woven and non-woven fabrics, and laminates thereof.

6. A coated abrasive as claimed in claim 2 in which the substrate is a foam.

7. A coated abrasive as claimed in claim 4 in which the substrate is a foam.

8. A coated abrasive as claimed in claim 3 in which the presize coating comprises a hot melt adhesive.

9. A coated abrasive as claimed in claim 4 in which the presize coating comprises a hot melt adhesive.

10. A coated abrasive as claimed in claim 8 or claim 9 in which the presize coating comprises ethylene vinyl acetate, polyethylene, polyamide or polyurethane.

11. A coated abrasive as claimed in claim 1 in which said layer is overcoated with a size coating.

12. A coated abrasive as claimed in claim 11 in which the size coating is a water-based coating.

13. A coated abrasive as claimed in either claim 11 or claim 12 in which the size coating is selected from the group consisting of acrylic adhesives; polyurethane adhesives; phenol-, melamine- or urea-formaldehyde adhesives; water-based epoxy adhesives, or combinations thereof.

14. A coated abrasive as claimed in claim 11 in which the size coating comprises an acrylic binder and calcium stearate.

15. A coated abrasive as claimed in claim 11 in which the size coating is present at a weight ranging from about 1 to 250 g/m$^2$ solids.

16. A coated abrasive as claimed in claim 11 which additionally comprises a supersize coating over the size coating.

17. A coated abrasive as claimed in claim 16 in which the supersize coating comprises a binder and calcium stearate.

18. A coated abrasive as claimed in claim 1 in which the hot melt polyurethane is present at a weight ranging from about 1 to 250 g/m$^2$.

19. A coated abrasive as claimed in claim 1 in which the substrate is sponge.

20. A coated abrasive as claimed in claim 19 in which the sponge is a sheet having a thickness in the range 2 to 15 mm.

21. A method of preparing a coated abrasive which comprises applying a layer of a moisture-curable hot melt polyurethane adhesive to a surface of a substrate, depositing a plurality of abrasive particles on said layer while the hot melt polyurethane adhesive is in a molten state, and exposing the hot melt polyurethane adhesive to conditions sufficient to cure the adhesive.

22. A method as claimed in claim 21 wherein the substrate is porous.

23. A method as claimed in claim 21 comprising the additional step of applying a presize layer on the surface of the substrate prior to application of the hot melt polyurethane adhesive.

24. A method as claimed in claim 22 comprising the additional step of applying a presize layer on the surface of the substrate prior to application of the hot melt polyurethane adhesive.

25. A method as claimed in claim 23 in which the presize is a hot melt adhesive and is applied in a molten state.

26. A method as claimed in claim 24 in which the presize is a hot melt adhesive and is applied in a molten state.

27. A method as claimed in either claim 25 or claim 26 in which the presize comprises ethylene vinyl acetate, polyethylene, polyamide, or polyurethane.

28. A method as claimed in any one of claims 21, 22 or 23 in which the substrate is selected from paper, plastics fibers, fibrous bases, woven and non-woven fabrics, and laminates thereof.

29. A method as claimed in claim 22 in which the substrate is a foam.

30. A method as claimed in claim 24 in which the substrate is a foam.

31. A method as claimed in claim 22 in which the substrate is sponge.

32. A coated abrasive as claimed in claim 31 in which the sponge is a sheet having a thickness in the range 2 to 15 mm.

33. A method as claimed in claim 21 in which the hot melt polyurethane adhesive is heated to a temperature of from 50° to 250° C. prior to application.

34. A method as claimed in claim 21 in which the hot melt polyurethane adhesive is heated to a temperature of about 120° C. prior to application.

35. A method as claimed in claim 21 in which the hot melt polyurethane adhesive is present at a weight ranging from about 1 to 250 g/m$^2$.

36. A method as claimed in claim 21 comprising the additional steps of applying a size coating precursor composition after application of the abrasive particles and exposing the composition to conditions sufficient cure the composition.

37. A method as claimed in claim 36 in which the size coating precursor composition is water-based.

38. A method as claimed in claim 36 in which the size coating precursor composition is selected from the group consisting of acrylic adhesives; polyurethane adhesives; phenol- melamine- or urea- formaldehyde adhesives; water-based epoxy adhesives; or combinations thereof.

39. A method as claimed in claim 36 in which the size coating precursor composition is present at a weight in the range 1 to 250 g/m$^2$ on a solids basis.

40. A method as claimed in claim 21 in which the abrasive particles are heated to a temperature of from 35° C. to 250° C. prior to deposition.

41. A method as claimed in claim 40 in which the abrasive particles are heated to a temperature of about 50° C. prior to deposition.

* * * * *